US008055438B2

(12) United States Patent
Neisen

(10) Patent No.: US 8,055,438 B2
(45) Date of Patent: Nov. 8, 2011

(54) AIR-FUEL RATIO SENSOR EARLY ACTIVATION FEEDBACK SYSTEM AND METHOD

(75) Inventor: Michael Neisen, Ostrander, OH (US)

(73) Assignee: Honda Motor Co., Ltd., Tokyo (JP)

( * ) Notice: Subject to any disclaimer, the term of this patent is extended or adjusted under 35 U.S.C. 154(b) by 493 days.

(21) Appl. No.: 12/389,694

(22) Filed: Feb. 20, 2009

(65) Prior Publication Data

US 2010/0212644 A1 Aug. 26, 2010

(51) Int. Cl.
*F02D 41/06* (2006.01)

(52) U.S. Cl. ..... 701/113; 123/142.5 E; 123/674; 123/697

(58) Field of Classification Search ..... 701/113; 123/142.5 E, 179.2, 674, 697
See application file for complete search history.

(56) References Cited

U.S. PATENT DOCUMENTS

| | | | | |
|---|---|---|---|---|
| 4,436,064 | A * | 3/1984 | Lamkewitz et al. | 123/142.5 R |
| 5,173,856 | A * | 12/1992 | Purnell et al. | 701/35 |
| 5,724,952 | A | 3/1998 | Miyashita et al. | |
| 5,778,844 | A * | 7/1998 | Kuttner | 123/179.6 |
| 6,028,372 | A * | 2/2000 | West et al. | 307/10.6 |
| 6,082,345 | A | 7/2000 | Ikeuchi et al. | |
| 6,559,558 | B2 | 5/2003 | Quesnel et al. | |
| 6,712,133 | B1 * | 3/2004 | Kyrtsos et al. | 165/239 |
| 7,130,743 | B2 * | 10/2006 | Kudo et al. | 701/209 |
| 7,240,750 | B2 * | 7/2007 | Patel | 180/65.265 |
| 7,305,299 | B2 | 12/2007 | Yasui et al. | |
| 7,337,772 | B2 | 3/2008 | Yasui et al. | |
| 7,542,827 | B2 * | 6/2009 | Gerard et al. | 701/2 |
| 7,693,647 | B2 * | 4/2010 | Suzuki | 701/113 |
| 2006/0150962 | A1 | 7/2006 | Uraki et al. | |
| 2007/0017719 | A1 * | 1/2007 | Patel | 180/65.5 |
| 2007/0073469 | A1 * | 3/2007 | Watanabe | 701/113 |
| 2008/0163445 | A1 | 7/2008 | King | |
| 2008/0179040 | A1 | 7/2008 | Rosenbaum | |

FOREIGN PATENT DOCUMENTS

| | | |
|---|---|---|
| JP | 2000-248988 | 12/2000 |

* cited by examiner

*Primary Examiner* — Erick Solis
(74) *Attorney, Agent, or Firm* — Rankin Hill & Clark LLP

(57) ABSTRACT

An air-fuel ratio sensor early activation feedback system and method includes an air-fuel ratio sensor for measuring an air-fuel ratio in an exhaust gas generated by an internal combustion engine and a heater for heating the air-fuel ratio sensor. A controller activates the heater prior to startup of the engine based on prior startup times for the engine.

20 Claims, 3 Drawing Sheets

AIR-FUEL RATIO SENSOR EARLY ACTIVATION FEEDBACK SYSTEM AND METHOD

BACKGROUND

The present disclosure generally relates to an air-fuel ratio control system for internal combustion engines, and more particularly relates to an air-fuel ratio sensor early activation feedback system and method.

Exhaust gas sensors are often disposed in the exhaust passages of internal combustion engines for detecting an exhaust gas component concentration for the purpose of controlling the operation of the internal combustion engine or monitoring the status of an exhaust gas purifying system. Specifically, an exhaust gas sensor (e.g., a linear air-fuel ratio sensor) can be disposed at a certain location in the exhaust gas passage and has an element sensitive to an exhaust gas component state to be detected, the element being position for contact with the exhaust gas flowing through the exhaust passage. For example, an air-ratio sensor, such as an oxygen concentration sensor or the like, can be disposed as an exhaust gas sensor upstream or downstream of an exhaust gas purifying catalyst disposed in the exhaust passage for the purpose of controlling the air-ratio of the internal combustion engine to maintain the purifying ability of the catalyst. This is done by using the measured air-fuel ratio to adjust the amount of fuel injected into the engine.

Some air-fuel ratio sensors have a built-in heater for heating the active element thereof for increasing the temperature of the element and activating the element to enable the element to perform its essential functions and also removing foreign matter deposited on the element. For example, when the air-fuel ratio sensor is an oxygen concentration sensor or the like, it can have an electric heater for heating the active element thereof. One such exemplary sensor is a hot wire type that needs to be heated before proper operation is possible. After the internal combustion engine has started to operate, the electric heater is energized to increase the temperature of the active element of the oxygen concentration sensor to activate the active element and keep the active element active.

With recent stricter regulation of exhaust gases, there is an increasing demand for starting the feedback control of the air-fuel ratio as early as possible after the start of the engine, and hence it is desired that the oxygen concentration sensor should become activated as early as possible after the start of the engine. Conventionally, to promote activation of the sensor, as discussed above, the sensor is heated by a heater and this heating does not begin until after the engine is started. Of course, the sensor typically cannot be heated to the activation temperature instantly after the start of the engine and heating. Thus, immediately after the start of the engine, the oxygen concentration sensor is not fully activated, and therefore, until the sensor becomes fully activated, exhaust gases from the engine can contain considerable amounts of unburned HC and sulfur components and hence are in an unstable or unpurified condition.

SUMMARY

According to one aspect, an air-fuel ratio sensor early activation system is provided. More particularly, in accordance with this aspect, the early activation system includes an air-fuel ratio sensor for measuring an air-fuel ratio in an exhaust gas generated by an internal combustion engine. The early activation system further includes a heater for heating the air-ratio sensor and a controller that activates the heater prior to start up of the engine based on prior startup times for the engine.

According to another aspect, a method is provided for early activation of an air-fuel ratio sensor that measures an air-fuel ratio in an exhaust gas of an internal combustion engine. More particularly, in accordance with this aspect, a future startup is predicted for the internal combustion engine based on prior startup times for the engine. An air-fuel ratio sensor heater is actuated at a predetermined time before the predicted future engine startup.

According to still another aspect, an early heating method is provided for an air-fuel sensor. More particularly, in accordance with this aspect, date and time information is recorded for each of a plurality of starts of an internal combustion engine. The date and time information for each of the plurality of starts of the engine is accumulated In a database. A startup time for the engine is predicted based on the date and time information in the database. An air-fuel sensor for the engine is activated at a predetermined time before the predicted startup time.

DETAILED DESCRIPTION

Figure 1:
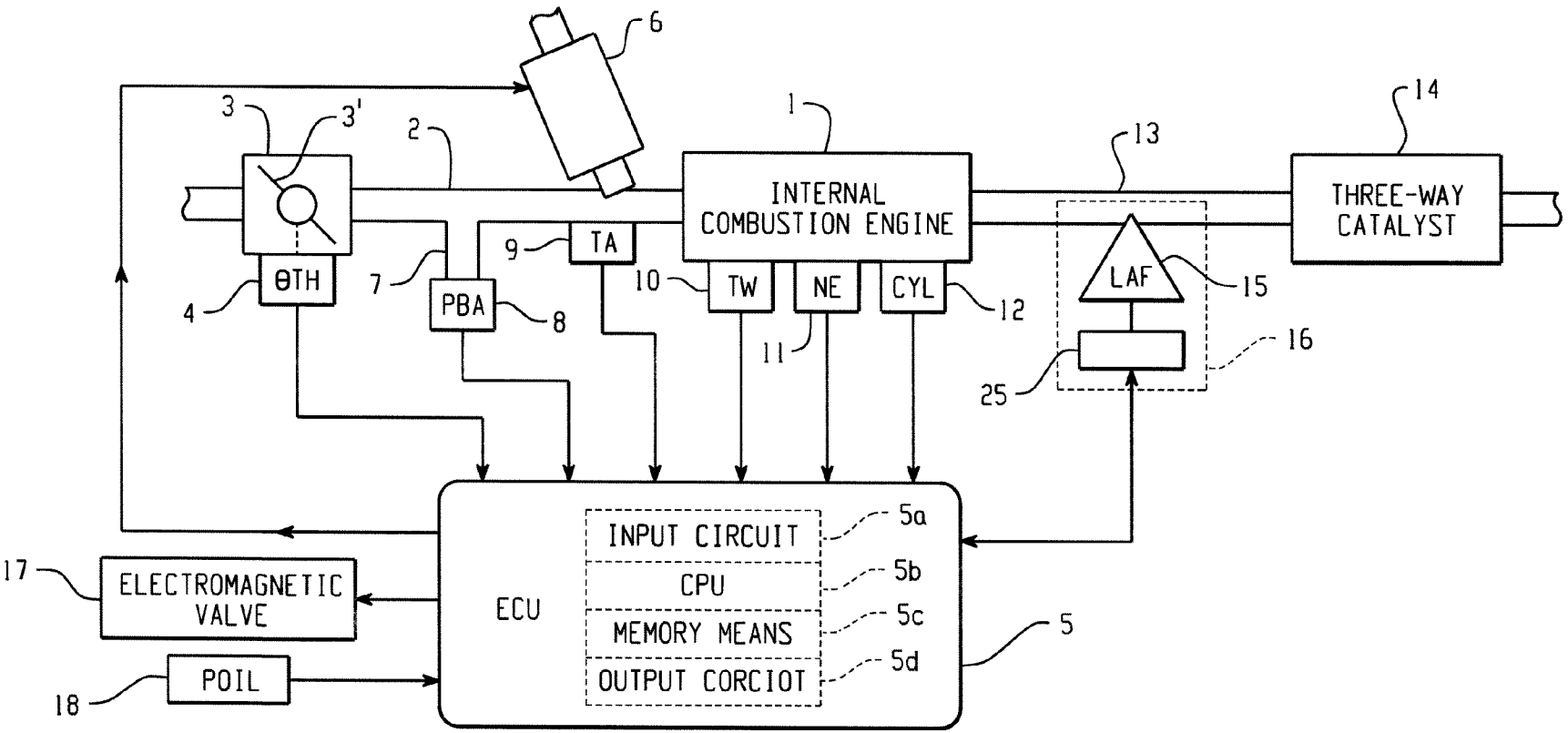
FIG. 1 is a schematic diagram showing an arrangement of an internal combustion engine and a control system therefor, including an air-fuel ratio control system.

Referring now to the drawings, wherein the showings are only for purposes of illustrating one or more exemplary embodiments and not for limiting the same, FIG. 1 schematically shows an internal combustion engine and a control system therefor, including an air-fuel ratio control system. More particularly, the illustrated system includes an internal combustion engine 1, such as a four-cylinder type DOHC in-line internal combustion engine, for example, though other types of internal combustion engines could be employed. As shown, the engine 1 has an intake pipe 2 across which is arranged a throttle body 3 accommodating a throttle valve 3'. A throttle valve opening (θ TH) sensor 4 is connected to the throttle valve 3' for generating an electric signal indicative of the sensed throttle valve opening θ TH and supplying the same to an electronic control unit (ECU) 5.

Fuel injection valves 6 are inserted into the intake pipe 2 for respective cylinders at locations intermediate between the cylinder block of the engine 1 and the throttle valve 3' and slightly upstream of the intake valves not shown) of the engine. The fuel injection valves 6 are connected to a fuel pump (not shown) and electrically connected to the ECU to have respective fuel injection periods (valve opening periods) thereof controlled by signals therefrom. In one embodiment, the ECU 5 directs fuel injector drivers (not shown) to vary a voltage for purposes of controlling fuel injection from the fuel injection valves 6.

An electromagnetic valve 17, which changes valve timing of the intake valves and exhaust valves (not shown) is electrically connected to the output side of the ECU 5 to have operation thereof controlled by a signal from the ECU 5. The electromagnetic valve 17 can change a hydraulic pressure supplied to a timing changeover mechanism (not shown) between a high value and a low value such that the mechanism operates in response to the hydraulic pressure to change the valve timing of the engine 1 between a high speed valve timing and a low speed valve timing. The hydraulic pressure within the valve timing changeover mechanism can be sensed by a hydraulic pressure (POIL) sensor 18, which is electrically connected to the ECU 5 to supply a signal indicative of the sensed hydraulic pressure to the ECU 5, which in turn controls the electromagnetic valve 17 in response to the signal.

An intake pipe absolute pressure (PBA) sensor 8 is provided in communication with the interior of the intake pipe 2 at a location immediately downstream of the throttle valve 3' through a conduit 7. The PBA sensor 8 is electrically connected to the ECU 5 for supplying a signal indicative of the sensed intake pipe absolute pressure PBA to the ECU 5. An intake air temperature (TA) sensor 9 is inserted into the intake pipe 2 at a location downstream of the PBA sensor 8 for supplying an electric signal indicative of the sensed intake air temperature TA to the ECU 5.

An engine coolant temperature (TW) sensor 10, which can be formed of a thermistor or the like, is mounted in the cylinder block of the engine 1 and filled with an engine coolant for supplying an electric signal indicative of the sensed engine coolant temperature TW to the ECU 5. An engine rotation speed (NE) sensor 11 and a cylinder-discriminating (CYL) sensor 12 are arranged in facing relation to a camshaft or a crankshaft of the engine 1 (neither of which is shown). The engine rotational speed sensor 11 generates a signal pulse at each of predetermined crank angle (e.g., whenever the crankshaft rotates through 180 degrees when the engine is of the 4-cylinder type) which each correspond to a predetermined crank angle before a top dead point (TDC) of each cylinder corresponding to the start of the suction stroke of the cylinder. The cylinder-discriminating sensor 12 generates a signal pulse or a CYL signal pulse at a predetermined crank angle of a particular cylinder of the engine 1. Signal pulses generated by the sensors 11, 12 are supplied to the ECU 5.

A three-way catalyst 14 is arranged in an exhaust pipe 13 of the engine 1, for purifying noxious components present in exhaust gases, such as HC, CO, NOx, etc. In one embodiment, a limiting current-type oxygen concentration or LAF sensor 15 is arranged in the exhaust pipe 13 in a location upstream of the three-way catalyst 14. The LAF sensor 15 constitutes an oxygen concentration-detecting device 16 together with an oxygen concentration detecting/activation control device 25. The LAF sensor 15 can be electrically connected through the control device 25 to the ECU 5, such that the sensor 15 supplies the control device 25 with an electric signal substantially proportional in value to the concentration of oxygen present in exhaust gases from the engine (i.e., the air-fuel ratio) and values of the oxygen concentration thus stored in a control device 25 are read out by the ECU 5.

The ECU 5 is comprised of an input circuit 5*a* having the functions of shaping the waveforms of input signals from the various sensors including the ones mentioned above, shifting the voltage levels of sensor output signals to a predetermined level, converting analog signals from analog-output sensors to digital signals, and so forth. The ECU 5 is also comprised of a central processing unit (CPU) 5*b*, a memory circuit 5*c* storing various operational programs which are executed by the CPU, and for storing results of calculations from the CPU, etc., and an output circuit 5*d* which outputs driving signals to the fuel injection valves 6 and the electromagnetic valve 17, etc. The CPU 5*b* operates in response to the above-mentioned signals from the sensors to determine operating conditions in which the engine 1 is operating, including air-fuel ratio feedback control carried out in response to outputs from the LAF sensor 15.

Figure 2:
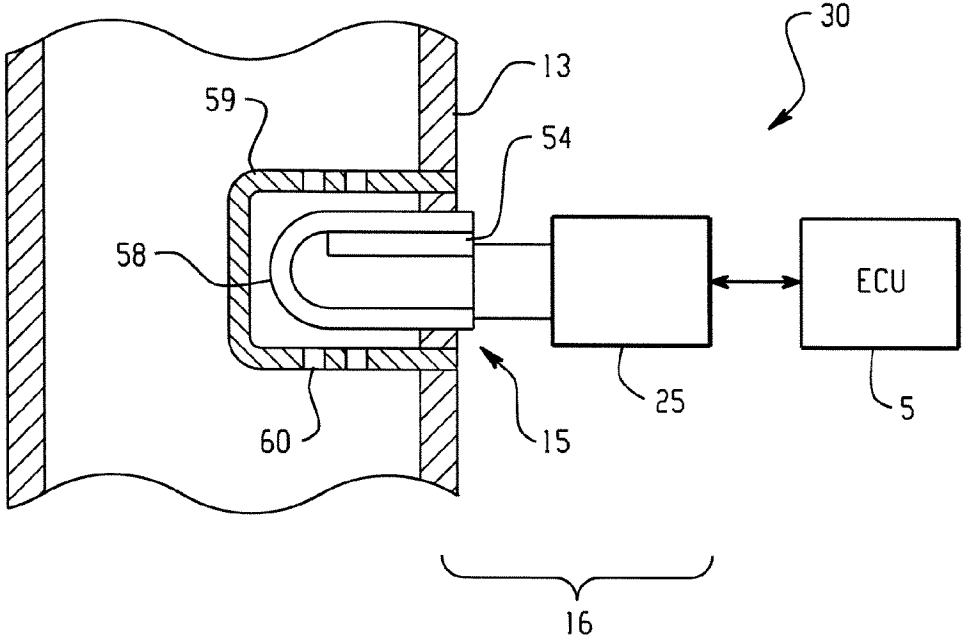
FIG. 2 is a schematic diagram showing details of the air-fuel ratio control system of FIG. 1, including an oxygen concentration-detecting device (i.e., an LAF sensor).

FIG. 2 shows details of the construction of the oxygen concentration-detecting device 16 of FIG. 1 and thus like reference numerals are used to identify like components. The oxygen concentration-detecting device 16 is comprised of the oxygen concentration or LAF sensor 15 and the control device 25. As shown, the LAF sensor 15 is inserted into the exhaust pipe 13 of the engine 1. In the illustrated embodiment, the LAF sensor 15 is comprised of a solid electrolyte element in the form of a cup 58 (though other configurations can be used) with a heater 54 mounted therein. In addition, the heater 54, which can be installed in thermal contact with the sensing element 58 as shown, can have a sufficient heating capacity for heating and activating the LAF sensor 15. The heater 54 can be a resistive heater that heats the sensing element 58 when a current is supplied thereto. The LAF sensor 15 can be enclosed within a cover 59 formed with small througholes 60 for permitting exhaust gases to flow into the cover 59, whereby the LAF sensor 15 is protected from being directly exposed to exhaust gases flowing in the exhaust pipe 13, with enhanced heat insulation of the LAF sensor 15. Thus, the cup 58 is a sensing element in contact with the exhaust gas flowing through the exhaust pipe 13 from the engine 1.

The controller 25 can deliver a detected value of oxygen concentration from the LAF sensor 15 to the ECU 5 and, when directed by the ECU 5, can activate the heater 54 for heating of the element 58. As will be described in more detail below, the LAF sensor, which measures an air-fuel ratio in the exhaust gas generated by the internal combustion engine 1, the heater 54, which heats the air-fuel ratio sensor 15, and the controller 25 and/or the ECU 5, one or both of which can activate the heater 54 prior to startup of the engine 1 based on prior startup times for the engine 1, together comprise an air-fuel ratio sensor early activation system 30. More particularly, one or both of the ECU 5 and the controller 25 can be configured to predict a startup time for the engine 1 based on prior startup times of the engine 1, and can be further configured to activate the heater 54 at a predetermined time (e.g., 5 minutes) prior to the predicted startup time of the engine 1. This allows the air-fuel ratio sensor 15 to measure the air-fuel ratio in the exhaust gas from the engine 1 immediately upon startup of the engine (when the startup is predicted) and then send a corresponding signal to the controller 25 and/or the ECU 5 indicative of the measured air-fuel ratio, also immediately upon startup of the engine when the startup is predicted. These functions can be configured as sections or modules stored and run by the ECU 5. For example, the sections or modules can be stored in the memory 5*c* of the ECU 5 and ultimately run by the CPU 5*b*.

Figure 3:
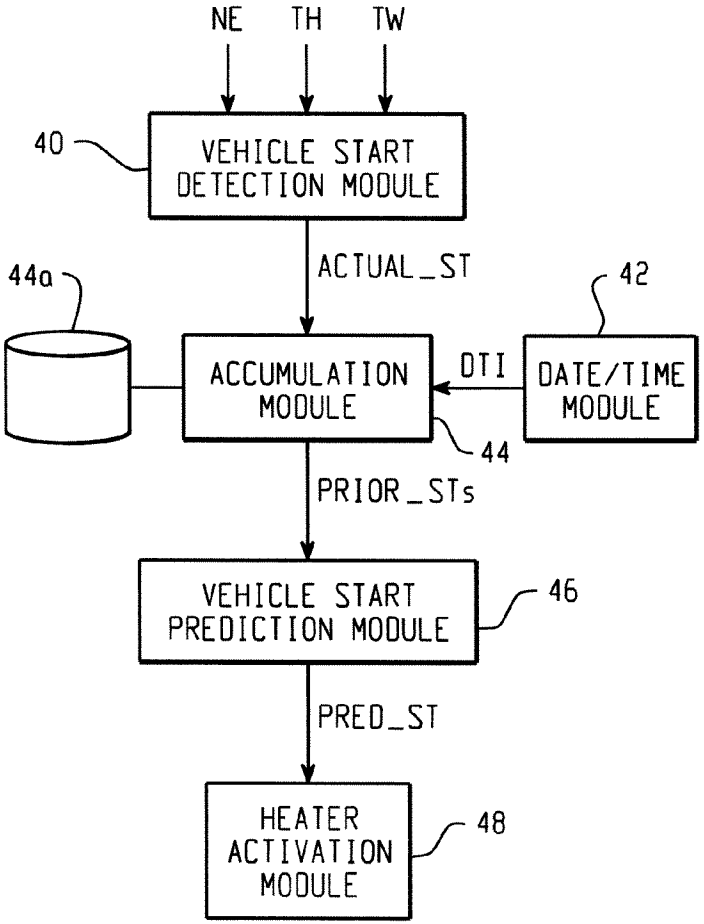
FIG. 3 is a block diagram showing functions of an air-fuel ratio sensor early activation feedback system.

FIG. 3 is a block diagram showing functions of the controller 25 and/or the ECU 5. More particularly, a vehicle start detection section or module 40 detects starting of the vehicle engine 1. To detect an actual start of the engine 1 (Actual_ST), the vehicle start detection module can depend on one or more sensors, such as the TW sensor 10, the NE sensor 11, and/or the CYL sensor 12, for example. Electric signals from the sensors indicative of conditions of the engine (e.g., coolant temperature, engine speed, and TDC signal pulses) can be used to determine that the engine 1 has been started. A date and time section or module 42 can detect date and time information (DTI) for each actual starting of the engine 1 (Actual_ST). An accumulation section or module 44 can record prior startup times of the engine 1 (Prior_Sts) based on: the recognized starting of the engine 1 Actual_ST from the vehicle start detection module 40 and the date and time information DTI from the date and time section or module 42. In particular, the accumulation module 44 can store (e.g., in a database 44*a* stored in the memory 5*c* of the ECU 5) records of actual starting of the engine 1 Actual_ST and particular date and time information DTI for each such actual starting of the engine 1.

A vehicle start predication section or module 46 can predict a future startup of the engine 1 (Pred_ST) based on the prior startup times (Prior_Sts) recorded by the accumulation module 44, as will be described in more detail below. In other words, the vehicle start prediction module 46 can predict one or more future startups of the engine 1 based on the records stored by the accumulation module 44 (e.g., the actual starts of the engine 1 and the corresponding date and time information DTI for such actual starts). Specifically, the ECU 5 can predict a timing of a future startup of the engine 1 when the date and time information DTI indicates a pattern for the plurality of engine startups. When a future startup (Pred_ST) is predicted by the vehicle start prediction module 46, the ECU 5 and/or the controller 25 can activate the heater 54 via a heater activation section or module 48 a predetermined time prior to the predicted timing for the startup of the engine 1.

Figure 4:
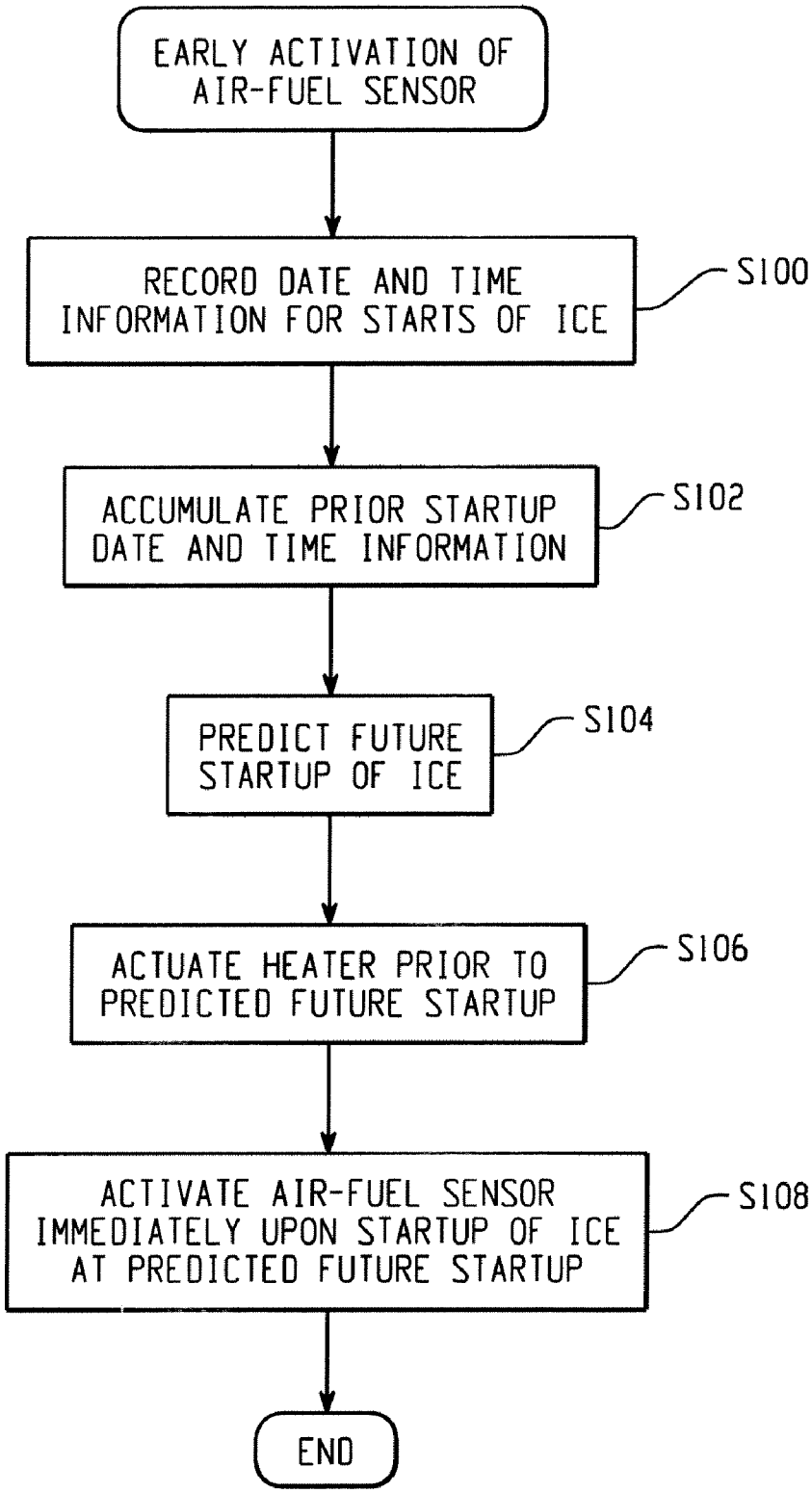
FIG. 4 is a flowchart showing an early activation process for an air-fuel sensor such as the LAF sensor of FIG. 2.

FIG. 4 is a flowchart of an early activation method for an air-fuel ratio sensor (e.g. LAF sensor 15) that measures an air-fuel ratio in an exhaust gas of an internal combustion engine. More particularly, in the illustrated early activation method, date and time information (DTI) is recorded for each start of the engine 1 (Actual_ST) in S100. In the system 30, date and time information DTI is provided by the date and time module 42, which can rely on an internal clock of the ECU 5. Such date and time information DTI is specifically provided for each actual vehicle start (Actual_ST) as determined by the vehicle start detection module 40. The prior startup times for the engine 1 (Prior_Sts), which includes the date and time information DTI for each of a plurality of engine startups of the engine 1 (Actual_ST), is accumulated in S102. Specifically, the accumulation module 44 can establish and/or update database 44*a* maintained in the memory 5*c* of the ECU 5. A future startup time for the engine 1 (Pred_ST) can then be predicted in S104 based on the prior startup times (Prior_Sts) for the engine 1.

More particularly, the future startup for the engine 1 (Pred_ST) can be predicted in S104 when the date and time information DTI corresponding to the prior startups of the engine (Actual_ST) indicates a pattern for the prior plurality of engine startups. A pattern could be indicted, for example, when the date and time information DTI for the actual engine starts (Actual_ST) shows repeated starting of the engine 1 within a specified window of time on a common day or days. A common day or days can include one of a particular weekday, a particular group of weekdays, all weekdays, a particular weekend day, or all weekend days, for example. Also for example, a specified window of time can be 15 minutes, although any window could be used.

Thus, by way of example only, if the engine 1 is started at approximately 9:00 am Monday through Friday corresponding to the vehicle user's morning commute time, and such starting occurs within a 15 minute window centered at about 9:00 am, the vehicle start prediction module 46 can predict a future startup of the engine 1 (Pred_ST) in S104 on future week days at 9:00 am. In particular, in this example, the vehicle start detection module 40 would detect a plurality of starts of the engine 1 (i.e., actual starts or Actual_ST) and the date and time module 42 would indicate the date and time information DTI at which these plurality of starts occurred. The accumulation module 44 records the date and time information DTI for the actual starts Actual_ST in database 44*a* establishing a record of prior startups of the engine (Prior_Sts). When a predetermined number of the actual starts Actual_ST are recorded in the database 44*a* with date and time information DTI indicating that the starts occurred within a fifteen minute window centered around 9:00 am and such starting occurs repeatedly on weekdays, the vehicle start prediction module 46 can predict future starting at the engine 1 (Pred_ST) on subsequent weekdays at 9:00 am. The predetermined number of actual starts could be ten, for example.

With a predicted future startup of the engine 1, the heater 54 can be actuated via the heater activation module 48 prior to the predicted future startup time (Pred_ST) in S106. In particular, the air-fuel ratio sensor heater 54 can be actuated at a predetermined time before the predicted future engine startup. Such predetermined time could be 10 seconds, for example. By actuating the heater 54 prior to a predicted future startup, the air-fuel or LAF sensor 15 can be activated immediately upon startup of the engine 1 when such startup does occur at the predicted future startup time in S108 because the LAF sensor 15 could be brought up to its activation temperature in advance of the engine starting. Thus, an air-fuel ratio signal from the LAF sensor 15 indicative of the air-fuel ratio of the exhaust gas can be provided to the ECU immediately upon startup of the engine 1 when such startup occurs at the predicted time.

Because vehicle drivers often follow a particular schedule during the week that involves using their vehicles at the same time several times per week, the system 30 can effectively predict future engine startups at least for driving that falls within the expected pattern or schedule. In particular, via the start prediction module 46, the ECU 5 can learn these times and use the information to anticipate a command to start the vehicle engine 1. Specifically, at the learned times (or at least a predetermined time before the learned times), the ECU 5 can activate the heater 54 so that the LAF sensor 15 can be fully heated and ready to deliver feedback control data immediately upon starting of the engine 1, rather than the approximately 10 seconds currently needed to heat up the LAF sensor before signals therefrom can be used.

It is to be appreciated that in connection with the particular exemplary embodiments presented herein certain structural and/or function features are described as being incorporated in defined elements and/or components. However, it is contemplated that these features may, to the same or similar benefit, also likewise be incorporated in common elements and/or components where appropriate. For example, the ECU 5 and the controller 25 may suitably be integrated together. It is also to be appreciated that different aspects of the exemplary embodiments may be selectively employed as appropriate to achieve other alternate embodiments suited for desired applications, the other alternate embodiments thereby realizing the respective advantages of the aspects incorporated therein.

It is also to be appreciated that particular elements or components described herein may have their functionality suitably implemented via hardware, software, firmware or a combination thereof. Additionally, it is to be appreciated that certain elements described herein as incorporated together may under suitable circumstances be stand-alone elements or otherwise divided. Similarly, a plurality of particular functions described as being carried out by one particular element may be carried out by a plurality of distinct elements acting independently to carry out individual functions, or certain individual functions may be split-up and carried out by a plurality of distinct elements acting in concert. Alternately, some elements or components otherwise described and/or shown herein as distinct from one another may be physically or functionally combined where appropriate.

An air-fuel ratio sensor early activation feedback system and method has been described with reference to specific exemplary embodiments. In short, it will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. The invention is not limited to only those embodiments and examples described above. Instead, the invention is intended to cover all alternatives, modifications, variations, improvements or alterations that come within the scope of the appended claims and the equivalents thereof.

What is claimed is:

1. An air-fuel ratio sensor early activation system, comprising:

an air-fuel ratio sensor for measuring an air-fuel ratio in an exhaust gas generated by an internal combustion engine;

a heater for heating said air-fuel ratio sensor; and a controller that activates said heater prior to startup of said engine based on prior startup times for said engine.

2. The early activation system of claim 1 wherein said controller is configured to predict a startup time for said engine based on said prior startup times, and further configured to activate said heater at a predetermined time prior to said startup time of said engine.

3. The early activation system of claim 1 wherein said air-fuel ratio sensor is an oxygen concentration sensor having a sensing element in contact with said exhaust gas.

4. The early activation system of claim 3 wherein said heater is installed in thermal contact with said sensing element for heating said sensing element when activated.

5. The early activation system of claim 4 wherein said heater is a resistive heater that heats said sensing element when a current is supplied to said heater.

6. The early activation system of claim 1 wherein said air-fuel ratio sensor measures said air-fuel ratio in said exhaust gas immediately upon startup of said engine and sends a signal to said controller indicative of said measured air-fuel ratio.

7. The early activation system of claim 1 wherein said controller accumulates said prior startup times including date and time information for each of a plurality of engine startups of said engine and predicts a timing of said startup when said date and time information indicates a pattern for said plurality of engine startups, said controller activating said heater a predetermined time prior to said timing.

8. The early activation system of claim 1 wherein said controller includes:

a vehicle start detection module for detecting starting of said vehicle engine;

a date and time module for detecting date and time information for each starting of said engine;

an accumulation module for recording said prior startup times based on said vehicle start detection module and said date and time module; and a vehicle start prediction module that predicts said startup of said engine based on said prior startup times recorded by said accumulation module.

9. A method for early activation of an air-fuel ratio sensor that measures an air-fuel ratio in an exhaust gas of an internal combustion engine, comprising:

predicting a future startup time for the internal combustion engine based on prior startup times for said engine; and actuating an air-fuel ratio sensor heater at a predetermined time before said predicted future engine startup time.

10. The method of claim 9 further including:

providing an air-fuel ratio signal indicative of the air-fuel ratio of the exhaust gas immediately upon startup of said engine.

11. The method of claim 9 wherein predicting said startup time based on said prior startup times includes:

accumulating prior startup times for said engine including date and time information for each of a plurality of engine startups of said engine; and predicting said future startup time when said date and time information indicates a pattern for said plurality of engine startups.

12. The method of claim 11 wherein said pattern is indicated when said date and time information shows repeated starting of said engine within a specified window of time on a common day or days.

13. The method of claim 12 wherein said common day or days includes one of a particular weekday, a particular group of weekdays, all weekdays, a particular weekend day, or all weekend days.

14. The method of claim 12 wherein said specified window of time is fifteen minutes.

15. An early heating method for an air-fuel sensor, comprising:

recording date and time information for each of a plurality of starts of an internal combustion engine;

accumulating said date and time information for each of said plurality of starts of said engine in a database;

predicting a startup time for said engine based on said date and time information in said database; and activating an air-fuel sensor for said engine at a predetermined time before said predicted startup time.

16. The early heating method of claim 15 further including:

measuring an air-fuel ratio in an exhaust gas generated by said internal combustion engine with said air-fuel sensor immediately upon startup of said engine at said predicted startup time.

17. The early heating method of claim 15 wherein predicting said startup time includes recognizing a pattern in said date and time information of said database.

18. The early heating method of claim 17 wherein recognizing said pattern includes determining that said engine is repeatedly started within a specified window of time on a common day or days.

19. The early heating method of claim 18 wherein said common day or days includes one of a particular weekday, a particular group of weekdays, all weekdays, a particular weekend day, or all weekend days.

20. The early heating method of claim 18 wherein said specified window of time is fifteen minutes.

* * * * *